US010696927B2

(12) United States Patent
Job et al.

(10) Patent No.: US 10,696,927 B2
(45) Date of Patent: Jun. 30, 2020

(54) DETERGENTS AND CLEANING AGENTS HAVING IMPROVED PERFORMANCE USING HYDROXY-5-QUINOLINE SULFONIC ACID

(71) Applicant: Henkel AG & Co. KGaA, Duesseldorf (DE)

(72) Inventors: Mareile Job, Leverkusen (DE); Nicole Bode, Duesseldorf (DE); Eva-Maria Wikker, Monheim (DE); Christian Kropf, Hilden (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/589,045

(22) Filed: May 8, 2017

(65) Prior Publication Data

US 2017/0240847 A1 Aug. 24, 2017

Related U.S. Application Data

(63) Continuation of application No. PCT/EP2015/075077, filed on Oct. 29, 2015.

(30) Foreign Application Priority Data

Nov. 10, 2014 (DE) ..... 10 2014 222 834

(51) Int. Cl.

| | |
|---|---|
| ***C11D 9/44*** | (2006.01) |
| ***C11D 3/28*** | (2006.01) |
| ***C11D 3/34*** | (2006.01) |
| ***C11D 11/00*** | (2006.01) |

(52) U.S. Cl.

CPC ..... *C11D 3/28* (2013.01); *C11D 3/349* (2013.01); *C11D 3/3481* (2013.01); *C11D 11/0017* (2013.01)

(58) Field of Classification Search

CPC ..... C11D 1/143

See application file for complete search history.

(56) References Cited

U.S. PATENT DOCUMENTS

| | | | | |
|---|---|---|---|---|
| 5,380,458 | A * | 1/1995 | Douglass | C01B 11/068 252/186.36 |
| 8,197,583 | B2 * | 6/2012 | Hotta | C23C 18/1607 106/1.23 |
| 2002/0011584 | A1 * | 1/2002 | Uchiyama | C11D 1/62 252/8.91 |
| 2002/0130937 | A1 * | 9/2002 | Hadjisoteriou | C09B 45/14 347/100 |
| 2006/0089284 | A1 | 4/2006 | Miracle et al. | |
| 2012/0077422 | A1 * | 3/2012 | Yoshino | B24B 37/044 451/59 |
| 2012/0157370 | A1 | 6/2012 | Kropf et al. | |
| 2012/0288570 | A1 * | 11/2012 | Zhu | D06L 4/12 424/616 |
| 2016/0366888 | A1 * | 12/2016 | Owens | A01N 43/80 |
| 2017/0233679 | A1 * | 8/2017 | Cetti | A61K 8/46 424/401 |

FOREIGN PATENT DOCUMENTS

| | | | |
|---|---|---|---|
| EP | 0132765 | A1 | 2/1985 |
| WO | 2007042140 | A2 | 4/2007 |
| WO | 2008080097 | A2 | 7/2008 |

OTHER PUBLICATIONS

PCT International Search Report (PCT/EP2015/075077) dated Jan. 14, 2016.

Soroka, Krystyna et al. "Fluorescence properties of metal complexes of 8-hydroxyquinoline-5-sulfonic acid and chromatographic applications". Analytical Chemistry, vol. 59. No. 4, Feb. 15, 1987, pp. 629-636. DOI: 10.1021/ac00131a019. https://cdn-pubs.acs.org/doi/pdf/10.1021/ac00131a019.

Notification Under Article 94(3) EPC EP Appln No. 15786973.6 dated Jul. 16, 2018 8 pages.

* cited by examiner

*Primary Examiner* — Charles I Boyer

(74) *Attorney, Agent, or Firm* — Bojuan Deng

(57) ABSTRACT

The present invention relates to the use of 8-hydroxyquinoline sulfonic acids in detergents and cleaning agents for improving the washing or cleaning performance with respect to bleachable stains.

14 Claims, No Drawings

DETERGENTS AND CLEANING AGENTS HAVING IMPROVED PERFORMANCE USING HYDROXY-5-QUINOLINE SULFONIC ACID

FIELD OF THE INVENTION

The present invention generally relates to the use of specific quinoline derivatives in detergents and cleaning agents for improving the washing or cleaning performance.

BACKGROUND OF THE INVENTION

Whereas the formulation of powdery bleach-containing detergents and cleaning agents nowadays no longer poses any problems, the formulation of stable, liquid, bleach-containing detergents and cleaning agents still poses a problem. Due to the usual absence of bleach in liquid detergents and cleaning agents, stains that normally are removed in particular on account of the contained bleach are accordingly often removed only insufficiently. A similar problem exists also for bleach-free color detergents, in which case the bleach is left out in order to protect the dyes in the textile and prevent the fading thereof. The absence of bleach exacerbates the fact that, instead of the removal of what are known as bleachable stains, which normally are removed at least in part by the peroxygen-based bleach, by contrast an intensification and/or worsening of the removability of the stain is often actually caused due to the washing process and not least is likely to be caused by initiated chemical reactions, which for example may consist of the polymerization of specific dyes contained in the stains.

Problems of this type occur particularly in the case of stains which contain polymerizable substances. The polymerizable substances are particularly polyphenolic dyes, preferably flavonoids, in particular from the class of anthocyanidins or anthocyanins. The stains can be caused in particular by food products or beverages containing corresponding dyes. In particular, the stains can be fruit or vegetable stains or also red wine stains, which in particular contain polyphenolic dyes, particularly those from the class of anthocyanidins or anthocyanins.

By way of example, the use of gallic acid esters such as propyl gallate in detergents and cleaning agents for the improved removal of stains containing polymerizable substances is known from international patent application WO 2011023716 A1.

The use of 4-pyridinones substituted at the N atom as appropriate with organic groups such as the methyl, ethyl, propyl, phenyl, naphthyl or carboxyethyl group for the removal of stains of textiles is known from the international patent application WO 2007042140 A2.

Accordingly, it is desirable to have novel washing and cleaning agents for improving the washing or cleaning performance with respect to bleachable stains. In addition, it is desirable to have an improved method that enhances the washing or cleaning performance with respect to bleachable stains. Furthermore, other desirable features and characteristics of the present invention will become apparent from the subsequent detailed description of the invention and the appended claims, taken in conjunction with this background of the invention.

BRIEF SUMMARY OF THE INVENTION

A first subject of the present invention is therefore the use of compounds of general formula (I)

(I)

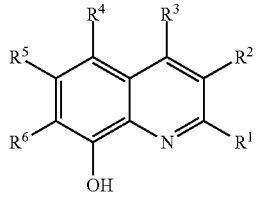

in which $R^1$, $R^2$, $R^3$, $R^4$, $R^5$ and $R^6$, independently of one another, stand for hydrogen or $SO_3X$ with the provision that at least 1 of said groups $R^1$ to $R^6$ is not hydrogen, and X stands for hydrogen, an alkali metal, or ammonium, in detergents or cleaning agents for improving the washing or cleaning performance with respect to bleachable stains.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has now surprisingly been found that by the use of 8-hydroxyquinoline sulfonic acids the washing or cleaning performance of the detergent or cleaning agent can be significantly improved, in particular with respect to bleachable stains.

The bleachable stains usually contain polymerizable substances, in particular polymerizable dyes, wherein the polymerizable dyes are preferably polyphenolic dyes, in particular flavonoids, particularly anthocyanidins or anthocyanins or oligomers of these compounds. Besides the removal of stains in the colors green, yellow, red or blue, the removal of stains in intermediate colors, in particular violet, lilac, brown, purple or pink, and also the removal of stains that have a green, yellow, red, violet, lilac, brown, purple, pink or blue tinge, without substantially completely existing of this color, are also considered. The specified colors in particular can also be light or dark in each case. Here, stains are preferably concerned that contain corresponding green, yellow, red, violet, lilac, brown, purple, pink and/or blue dyes, in particular grass, fruit or vegetable stains, in particular also stains caused by food products, such as spices, sauces, chutneys, curries, purees and marmalades, or beverages, for example coffee, tea, wine and juices.

The stains to be removed in accordance with the invention in particular can be caused by cherry, morello cherry, grape, apple, pomegranate, chokeberry, plum, buckthorn, acai, kiwi, mango, grass or berries, particularly by redcurrants or blackcurrants, elderberries, blackberries, raspberries, blueberries, cranberries, lingonberries, strawberries or huckleberries, by coffee, tea, red cabbage, blood orange, eggplant, tomato, carrot, beetroot, spinach, peppers, red-fleshed or blue-fleshed potatoes, or red onion.

In the compounds of general formula (I), there are preferably 1 to 4, in particular 1 to 2 $SO_3X$ substituents contained. $R^4$ is preferably an $SO_3X$ substituent. Preferred alkali metals for X are sodium and potassium and mixtures thereof. The ammonium ions for X, in addition to $NH_4^+$, are also ammonium groups carrying a total of 1 to 4 $C_{1-12}$ alkyl groups and/or $C_{2-5}$ hydroxyalkyl groups.

The use according to the invention of the compound of general formula (I) in detergents or cleaning agents is preferably provided in that it is used in an amount of from 0.01 wt. % to 10 wt. %, in particular in an amount of from 0.05 wt. % to 5 wt. %, wherein here and hereinafter the specifications of "wt. %" relate in each case to the weight of the total detergent or cleaning agent. A further subject of the invention is therefore a detergent or cleaning agent containing a compound of general formula (I) in an amount preferably of from 0.01 wt. % to 10 wt. %, in particular 0.05 wt. % to 5 wt. %, wherein the preferred embodiments described above and below also apply to this subject of the invention. An agent of this type is used in conventional washing or cleaning processes to be carried out by machine or by hand, in which soiled laundry or a soiled hard surface is exposed to an aqueous liquor containing the agent with the objective of removing the staining from the textile or hard surface.

The detergent or cleaning agent can be present in any delivery form established in accordance with the prior art and/or in any expedient delivery form. This includes for example solid, powdered, liquid, gel-like or pasty delivery forms, optionally also consisting of a number of phases; also included, for example, are: extrudates, granules, tablets or pouches, packaged both in bulk packs and in portions.

The use according to the invention is implemented here in a preferred embodiment in a detergent and cleaning agent containing no oxidative bleach. This is to be understood to mean that the agent does not contain any oxidative bleach in the narrower sense, including hypochlorite, hydrogen peroxide, or hydrogen peroxide-supplying substances and peroxoacids; it also does not comprise any bleach activators and/or bleach catalysts.

The detergent in a particularly preferred embodiment is a liquid textile detergent.

The detergent in a further particularly preferred embodiment is a powdered or liquid color detergent, that is to say a textile detergent for dyed textiles.

The detergent or cleaning agent, in addition to the active substance essential to the invention, can also contain other conventional constituents of detergents or cleaning agents, in particular textile detergents, in particular selected from the group of builders and surfactants and also preferably polymers, enzymes, disintegration aids, fragrances, and perfume carriers.

The builders in particular include the zeolites, silicate, carbonates, organic co-builders and, if there are no ecological objections to the use, also phosphates.

The fine-crystalline, synthetic zeolite containing bound water is preferably zeolite A and/or zeolite P. By way of example, zeolite MAP® (trade product from the company Crosfield) is possible as zeolite P. However, zeolite X and mixtures of zeolite A, X and/or P are also suitable. By way of example, a co-crystallizate of zeolite X and zeolite A (approximately 80 wt. % zeolite X), which can be described by the formula $$n\mathrm{Na_2O}.(1\text{-}n)\mathrm{K_2O}.\mathrm{Al_2O_3}.(21.5)\mathrm{SiO_2}.(3.5\text{-}5.5)\mathrm{H_2O},$$

is also commercially available and usable within the scope of the present invention. Here, the zeolite can be used both as builder in a granular compound and as a sort of "powdering" of a granular mixture, preferably of a mixture that is to be compacted, wherein both ways are usually used in order to incorporate the zeolite into the preliminary mixture. Zeolites can have a mean particle size of less than 10 μm (volume distribution; measurement method: Coulter Counter) and preferably contain 18 wt. % to 22 wt. %, in particular 20 to 22 wt. % of bound water.

Crystalline sheet silicates of general formula $NaMSi_xO_{2x+1}.y\ H_2O$ can also be used, in which M is sodium or hydrogen, x is a number from 1.9 to 22, preferably from 1.9 to 4, wherein particularly preferred values for x are 1, 2, 3 or 4, and y stands for a number from 0 to 33, preferably from 0 to 20. The crystalline sheet silicates of formula $NaMSi_xO_{2x+1}.y\ H_2O$ are sold for example by the company Clariant GmbH (Germany) under the trade names Na-SKS. Examples of these silicates are Na-SKS-1 ($Na_2Si_{22}O_{45}.x\ H_2O$, kenyaite), Na-SKS-2 ($Na_2Si_{14}O_{29}.x\ H_2O$, magadiite), Na-SKS-3 ($Na_2Si_8O_{17}.x\ H_2O$) or Na-SKS-4 ($Na_2Si_4O_9.x\ H_2O$, makatite).

Crystalline sheet silicates of general formula $NaMSi_xO_{2x+1}.y\ H_2O$ in which x stands for 2 are preferred. In particular, both β- and δ-sodium disilicates $Na_2Si_2O_5.y\ H_2O$ and also particularly Na-SKS-5 ($\alpha$-$Na_2Si_2O_5$), Na-SKS-7 ($\alpha$-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$), but in particular Na-SKS-6 ($\delta$-$Na_2Si_2O_5$) are preferred. Detergents or cleaning agents preferably contain a proportion by weight of the sheet silicate of formula $NaMSi_xO_{2x+1}.y\ H_2O$ of from 0.1 wt. % to 20 wt. %, preferably from 0.2 wt. % to 15 wt. %, and in particular from 0.4 wt. % to 10 wt. %.

Amorphous sodium silicates having a modulus $Na_2O$:$SiO_2$ of from 1:2 to 1:3.3, preferably from 1:2 to 1:2.8, and in particular from 1:2 to 1:2.6, which preferably have delayed dissolution and also secondary washing properties can also be used. The delay in dissolution compared to conventional amorphous sodium silicates can be brought about here in different ways, for example by surface treatment, compounding, compaction/compression or by overdrying. The term "amorphous" is understood to mean that the silicates do not provide sharp x-ray reflections in x-ray diffraction experiments, as are typical for crystalline substances, but at best provide one or more maxima of the scattered x-radiation having a width of a number of degrees of the angle of diffraction.

Alternatively or in combination with the aforementioned amorphous sodium silicates, x-ray amorphous silicates can be used, of which the silicate particles in electron diffraction experiments provide blurred or even sharp diffraction maxima. This can be interpreted such that the products have microcrystalline regions measuring from ten to several hundred nm in size, wherein values up to a maximum of 50 nm and in particular up to a maximum of 20 nm are preferred. X-ray amorphous silicates of this type also have a delayed dissolution compared to the conventional water glasses. Compressed/compacted amorphous silicates, compounded amorphous silicates, and overdried x-ray amorphous silicates are particularly preferred.

This/these silicate(s), preferably alkali silicates, particularly preferably crystalline or amorphous alkali disilicate(s), when present, is/are contained in detergents or cleaning agents in amounts of from 3 wt. % to 60 wt. %, preferably from 8 wt. % to 50 wt. %, and in particular from 20 wt. % to 40 wt. %.

A use of the generally known phosphates as builder substances is also possible, provided such a use should not be avoided for ecological reasons. Among the multitude of commercially available phosphates, the alkali metal phosphates in the detergent and cleaning agent industry are the most important, with particular preference for pentasodium and pentapotassium phosphate (sodium and potassium tripolyphosphate).

Here, alkali metal phosphates is the collective term for the alkali metal (in particular sodium and potassium) salts of the various phosphoric acids, in which a distinction can be made between metaphosphoric acids $(HPO_3)_n$ and orthophosphoric acid $H_3PO_4$ in addition to higher molecular representatives. Here, the phosphates combine several advantages: they act as alkali carriers, prevent lime deposits on machine parts and lime incrustations in fabrics, and additionally contribute to cleaning performance. Technically particularly important phosphates are the pentasodium triphosphate, $Na_5P_3O_{10}$ (sodium tripolyphosphate) and the corresponding potassium salt pentapotassium triphosphate $K_5P_3O_{10}$ (potassium tripolyphosphate). The sodium potassium tripolyphosphates are also preferably used. If phosphates are used in detergents or cleaning agents, preferred agents contain this/these phosphate(s), preferably alkali metal phosphate(s), particularly preferably pentasodium or pentapotassium triphosphate (sodium or potassium tripolyphosphate), in amounts of from 5 wt. % to 80 wt. %, preferably from 15 wt. % to 75 wt. %, and in particular from 20 wt. % to 70 wt. %.

Alkali carriers can also be used. By way of example, alkali metal hydroxides, alkali metal carbonates, alkali metal hydrogen carbonate, alkali metal sesquicarbonates, the aforementioned alkali silicates, alkali metasilicates, and mixtures of the aforementioned substances are potential alkaline carriers, wherein the alkali carbonates, in particular sodium carbonate, sodium hydrogen carbon, or sodium sesquicarbonate are preferably used. A builder system containing a mixture of tripolyphosphate and sodium carbonate can be particularly preferred. On account of their low chemical compatibility, compared with other builder substances, with the other ingredients of detergents or cleaning agents, the alkali metal hydroxides are usually used only in small amounts, preferably in amounts of less than 10 wt. %, preferably less than 6 wt. %, particularly preferably less than 4 wt. %, and in particular less than 2 wt. %. Agents which, in relation to their total weight, contain less than 0.5 wt. % and in particular no alkali metal hydroxides are particularly preferred. The use of carbonate(s) and/or hydrogen carbonate(s), preferably alkali carbonate(s), particularly preferably sodium carbonate, in amounts of from 2 wt. % to 50 wt. %, preferably from 5 wt. % to 40 wt. %, and in particular from 7.5 wt. % to 30 wt. %, is preferred.

Polycarboxylates/polycarboxylic acids, polymer polycarboxylates, aspartic acid, polyacetals, dextrins and phosphonates can be cited in particular as organic builders. By way of example, polycarboxylic acids usable in the form of the free acid and/or the sodium salts can be used, wherein polycarboxylic acids are understood to mean those carboxylic acids that carry more than one acid function. By way of example, these are citric acid, adipic acid, succinic acid, glutaric acid, malic acid, tartaric acid, maleic acid, fumaric acid, sugar acids, amino carboxylic acids, nitrilotriacetic acid (NTA), provided such a use should not be avoided for ecological reasons, and mixtures thereof. The free acids, in addition to the building effect, typically also have the property of an acidifying component and thus also serve to set a lower and milder pH value of detergents or cleaning agents. In particular, citric acid, succinic acid, glutaric acid, adipic acid, gluconic acid, and any mixtures thereof can be cited here. Further polymer polycarboxylates are suitable as builders, and for example are the alkali metal salts of polyacrylic acid or polymethacrylic acid, for example those having a relative molecular mass of from 500 g/mol to 70,000 g/mol. In particular, polyacrylates which preferably have a molecular mass of from 2,000 g/mol to 20,000 g/mol are suitable. On account of their superior solubility, the short-chain polyacrylates having molar masses of from 2,000 g/mol to 10,000 g/mol, and particularly preferably from 3,000 g/mol to 5,000 g/mol can in turn be preferred from this group. Furthermore, copolymer polycarboxylates are suitable, in particular those of acrylic acid with methacrylic acid and those of acrylic acid or methacrylic acid with maleic acid. Copolymers of acrylic acid with maleic acid containing 50 wt. % to 90 wt. % acrylic acid and 50 wt. % to 10 wt. % maleic acid have proven to be particularly suitable. Their relative molecular mass, in relation to free acids, is generally 2,000 g/mol to 70,000 g/mol, preferably 20,000 g/mol to 50,000 g/mol, and in particular 30,000 g/mol to 40,000 g/mol. In order to improve the water solubility, the polymers can also contain allylsulfonic acids, such as allyloxybenzene sulfonic acid and methallyl sulfonic acid, as monomer. The (co)polymer polycarboxylates can be used as solid or in aqueous solution. The content of (co) polymer polycarboxylates in detergents or cleaning agents is preferably 0.5 wt. % to 20 wt. %, and in particular 3 wt. % to 10 wt. %.

Biologically degradable polymers consisting of more than two different monomer units, for example those which as monomers contain salts of acrylic acid and maleic acid and also vinyl alcohol or vinyl alcohol derivatives or which as monomers contain salts of acrylic acid and 2-alkyl allyl sulfonic acid and also sugar derivatives are also particularly preferred. Further preferred copolymers are those which as monomers comprise acrolein and acrylic acid/acrylic acid salts or acrolein and vinyl acetate. Polymeric amino dicarboxylic acids, the salts thereof or precursor substances thereof can also be mentioned as further preferred builder substances. Polyaspartic acids and/or salts thereof are particularly preferred.

A further substance class with builder properties is provided by the phosphonates. These are the salts of in particular hydroxyalkane or aminoalkane phosphonic acids. Among the hydroxyalkane phosphonic acids, 1-hydroxyethane-1,1-diphosphonic acid (HEDP) is of particular importance. It is especially used as a sodium salt, the disodium salt being neutral and the tetrasodium salt reacting in an alkaline manner. Ethylenediamine tetramethylene phosphonic acid (EDTMP), diethylenetriamine pentamethylene phosphonic acid (DTPMP), and higher homologs thereof are particularly suitable as aminoalkane phosphonic acids. They are especially used in the form of the neutrally reacting sodium salts, for example as hexasodium salt of EDTMP or as hepta- and octasodium salt of DTPMP. Mixtures of said phosphonates can also be used as organic builders. In particular, the aminoalkane phosphonates additionally have a marked heavy metal binding capacity Further suitable builder substances are polyacetals which can be obtained by reacting dialdehydes with polycarboxylic acids having 5 to 7 C atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, for example oligomers or polymers of carbohydrates which can be obtained by partial hydrolysis of starches. The hydrolysis can be carried out by customary, for example acid- or enzyme-catalyzed, processes. The hydrolysis products are preferably hydrolysis products with average molar masses in the range from 400 to 500,000 g/mol. Here, a polysaccharide with a dextrose equivalent (DE) in the range from 0.5 to 40, in particular from 2 to 30, is preferred, wherein DE is a customary measure for the reducing effect of a polysaccharide compared with dextrose, which has a DE of 100. It is possible to use both maltodextrins with a DE between 3 and 20 and dry glucose syrups with a DE between 20 and 37, and also so-called yellow dextrins and white dextrins with higher molar masses in the range from 2,000 to 30,000 g/mol. The oxidized derivatives of such dextrins are their reaction products with oxidizing agents which are able to oxidize at least one alcohol function on the saccharide ring to the carboxylic acid function.

Oxydisuccinates and other derivatives of disuccinates, preferably ethylenediamine disuccinate, are further suitable cobuilders. Ethylenediamine N,N'-disuccinate (EDDS) is preferably used here in the form of its sodium or magnesium salts. In addition, preference is also given in this context to glycerol disuccinates and glycerol trisuccinates. If desired, suitable quantities for use lie at 3 wt. % to 15 wt. %, in particular in zeolite-containing and/or silicate-containing formulations.

Further organic cobuilders which can be used are, for example, acetylated hydroxycarboxylic acids and salts thereof, which can optionally also be in the lactone form and which comprise at least 4 carbon atoms and at least one hydroxyl group and at most two acid groups.

In addition, all compounds that are capable of forming complexes with alkaline earth ions can be used as builders.

Detergents and cleaning agents can contain non-ionic, anionic, cationic and/or amphoteric surfactants.

All non-ionic surfactants known to a person skilled in the art can be used as non-ionic surfactants. Detergents or cleaning agents particularly preferably contain non-ionic surfactants from the group of alkoxylated alcohols. Alkoxylated, advantageously ethoxylated, in particular primary alcohols having preferably 8 to 18 C atoms and on average 1 to 12 mol of ethylene oxide (EO) per mol of alcohol are preferably used as non-ionic surfactants, in which alcohols the alcohol group can be linear or preferably methyl-branched in the 2 position or can contain linear and methyl-branched groups in a mixture, as are usually present in oxoalcohol groups. In particular, however, alcohol ethoxylates with linear groups from alcohols of native origin having 12 to 18 C atoms, for example from coconut, palm, tallow fatty or oleyl alcohol, and with on average 2 to 8 mol of EO per mol of alcohol are preferred. The preferred ethoxylated alcohols for example include $C_{12-14}$ alcohols with 3 EO or 4 EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures thereof, and mixtures of $C_{12-14}$ alcohol with 3 EO and $C_{12-18}$ alcohol with 5 EO. The specified degrees of ethoxylation are statistical average values, which for a specific product can correspond to an integer or a fractional number. Preferred alcohol ethoxylates have a narrowed homolog distribution (narrow range ethoxylates, NRE).

Alternatively or additionally to these nonionic surfactants, fatty alcohols with more than 12 EO may also be used. Examples of these are tallow fatty alcohol with 14 EO, 25 EO, 30 EO or 40 EO. Alkyl glycosides of general formula $RO(G)_x$, in which R corresponds to a primary straight-chain or methyl-branched aliphatic group, in particular methyl-branched in the 2 position, having 8 to 22, preferably 12 to 18 C atoms, and G is a symbol that stands for a glycose unit having 5 or 6 C atoms, preferably for glucose, can also be used as further non-ionic surfactants. The degree of oligomerization x, which specifies the distribution of monoglycosides and oligoglycosides, is any number between 1 and 10; x is preferably from 1.2 to 1.4.

A further class of non-ionic surfactants that can be used with preference and which are used either as sole non-ionic surfactant or in combination with other non-ionic surfactants are alkoxylated, preferably ethoxylated or ethoxylated and propoxylated fatty acid alkyl esters, preferably having 1 to 4 carbon atoms in the alkyl chain.

Non-ionic surfactants of the amine oxide type, for example N-coco alkyl-methylamine oxide and N-tallow alkyl-N, N-dihydroxyethylamine oxide, and the fatty acid alkanolamides may also be used. The amount of these non-ionic surfactants is preferably no more than that of the ethoxylated fatty alcohols, in particular no more than half thereof.

Further suitable surfactants are polyhydroxy fatty acid amides of formula

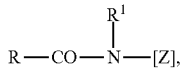

in which R stands for an aliphatic acyl group having 6 to 22 carbon atoms, $R^1$ stands for hydrogen, an alkyl group or hydroxyalkyl group having 1 to 4 carbon atoms, and [Z] stands for a linear or branched polyhydroxyalkyl group having 3 to 10 carbon atoms and 3 to 10 hydroxyl groups. The polyhydroxy fatty acid amides are known substances which can normally be obtained by reductive amination of a reducing sugar with ammonia, an alkyl amine or an alkanol amine and subsequent acylation with a fatty acid, a fatty acid alkyl ester or a fatty acid chloride. The group of polyhydroxy fatty acid amides also includes compounds of formula

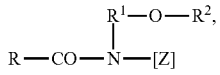

in which R stands for a linear or branched alkyl or alkenyl group having 7 to 12 carbon atoms, $R^1$ stands for a linear, branched or cyclic alkyl group or an aryl group having 2 to 8 carbon atoms, and $R^2$ stands for a linear, branched or cyclic alkyl group or an aryl group or an oxo alkyl group containing 1 to 8 carbon atoms, $C_{1-4}$ alkyl groups or phenyl groups being preferred, and [Z] stands for a linear polyhydroxyalkyl group, of which the alkyl chain is substituted with at least two hydroxyl groups, or alkoxylated, preferably ethoxylated or propoxylated derivatives of this group. [Z] is preferably obtained by reductive amination of a reduced sugar, for example glucose, fructose, maltose, lactose, galactose, mannose or xylose. The N-alkoxy-substituted or N-aryloxy-substituted compounds can then be converted into the desired polyhydroxy fatty acid amides by reaction with fatty acid methyl esters in the presence of an alkoxide as catalyst.

In cleaning agents, biosurfactants from the group of alkoxylated alcohols, particularly preferably from the group of mixed alkoxylated alcohols and in particular from the group of EO/AO/EO biosurfactants, or PO/AO/PO biosurfactants, especially PO/EO/PO biosurfactants are particularly preferred. Such PO/EO/PO biosurfactants are characterized by good foam control.

By way of example, surfactants of the sulfonate and sulfate type can be used as anionic surfactants. Here, possible surfactants of the sulfonate type are preferably $C_{9-13}$ alkyl benzene sulfonates, olefin sulfonates, i.e. mixtures of alkene and hydroxyalkane sulfonates, and also disulfonates, as are obtained for example from $C_{12-18}$ monoolefins with terminal or internal double bond by sulfonation with gaseous sulfur trioxide and subsequent alkaline or acidic hydrolysis of the sulfonation products. Alkane sulfonates that are obtained from $C_{12-18}$ alkanes for example by sulfo-chlorination or sulfoxidation with subsequent hydrolysis or neutralization are also suitable. Also, the esters of α-sulfo fatty acids (ester sulfonates), for example the α-sulfonated methyl esters of hydrogenated coconut fatty acids, palm kernel fatty acids or tallow fatty acids are also suitable.

Further suitable anionic surfactants are sulfated fatty acid glycerol esters. Fatty acid glycerol esters are understood to be the monoesters, diesters and triesters and also the mixtures thereof, as are obtained in the production by esterification of a monoglycerol having 1 to 3 mol of fatty acid or in the re-esterification of triglycerides having 0.3 to 2 mol of glycerol. Here, preferred sulfated fatty acid glycerol esters are the sulfation products of saturated fatty acids having 6 to 22 carbon atoms, for example of caproic acid, caprylic acid, capric acid, myristic acid, lauric acid, palmitic acid, stearic acid or behenic acid.

The alkaline salts and in particular the sodium salts of the sulfuric acid semi-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of the $C_{10}$-$C_{20}$ oxo alcohols and those semi-esters of secondary alcohols of these chain lengths are preferred as alk(en)yl sulfates. Alk(en)yl sulfates of the specified chain length that contain a synthetic straight-chain alkyl group produced on petrochemical basis, and that have a degradation behavior similar to the suitable compounds based on fatty chemical raw materials, are further preferred. The $C_{12}$-$C_{16}$ alkyl sulfates and $C_{12}$-$C_{15}$ alkyl sulfates and also $C_{14}$-$C_{15}$ alkyl sulfates are preferred from a washing viewpoint.

The sulfuric acid monoesters of the straight-chain or branched $C_{7-21}$ alcohols ethoxylated with 1 to 6 mol of ethylene oxide, such as 2-methyl-branched $C_{9-11}$ alcohols containing on average 3.5 mol of ethylene oxide (EO) or $C_{12-18}$ fatty alcohols containing 1 to 4 EO, are also suitable. Due to their high foaming behavior, they are used in cleaning agents only in relatively small amounts, for example in amounts of from 1 wt. % to 5 wt. %.

Further suitable anionic surfactants are also the salts of alkyl sulfosuccinic acid, which are also referred to as sulfosuccinates or as sulfosuccinic acid esters and represent the monoesters and/or diesters of sulfosuccinic acid containing alcohols, preferably fatty alcohols and in particular ethoxylated fatty alcohols. Preferred sulfosuccinates contain $C_{8-18}$ fatty alcohol groups or mixtures thereof. In particular, preferred sulfosuccinates contain a fatty alcohol group that derives from ethoxylated fatty alcohols, which, in themselves, represent non-ionic surfactants. Here, sulfosuccinates of which the fatty alcohol groups derive from ethoxylated fatty alcohols with narrowed homolog distribution are particularly preferred. It is also possible to use alk(en)yl succinic acid having preferably 8 to 18 carbon atoms in the alk(en)yl chain, or the salts thereof.

In particular, soaps can be considered as further anionic surfactants. Saturated fatty acid soaps are suitable, such as the salts of lauric acid, myristic acid, palmitic acid, stearic acid, hydrogenated erucic acid and behenic acid and also in particular soap mixtures derived from natural fatty acids, for example coconut fatty acids, palm kernel fatty acids, or tallow fatty acids.

The anionic surfactants, including soaps, can be present in the form of their sodium, potassium or ammonium salts and also as soluble salts of organic bases, such as monoethanolamine, diethanolamine or triethanolamine. The anionic surfactants are preferably present in the form of their sodium or potassium salts, in particular in the form of the sodium salts.

Cationic and/or amphoteric surfactants can also be used instead of the aforementioned surfactants or in combination therewith.

By way of example, cationic compounds of the following formulas can be used as cationic active substances:

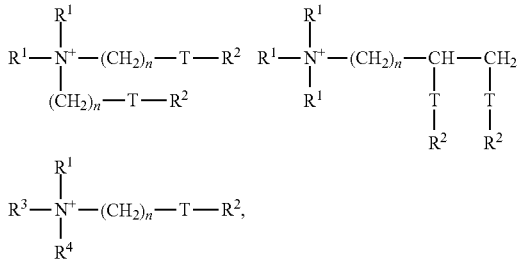

in which each group $R^1$, independently of one another, is selected from $C_{1-6}$ alkyl, alkenyl or hydroxylalkyl groups; each group $R^2$, independently of one another, is selected from $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O— and n is an integer from 0 to 5.

In order to care for the textiles and improve the textile properties, such as a softer "feel" (softening) and reduced electrostatic charge (increased wearing comfort), compounds that make textiles soft can be used. The active substances of these formulations are quaternary ammonium compounds having two hydrophobic groups, such as distearyl dimethyl ammonium chloride, although on account of its unsatisfactory biological degradability it is being replaced increasingly by quaternary ammonium compounds, which in their hydrophobic groups contain ester groups as predetermined breaking points for the biological degradation.

Such "esterquats" with improved biological degradability are obtainable for example in that mixtures of methyl diethanolamines and/or triethanolamine are esterified with fatty acids and the reaction products are then quaternized with alkylation agents, as is known per se. Dimethylol ethylene urea is also suitable as finishing agent.

Enzymes can be used in order to increase the performance of detergents or cleaning agents. These include in particular proteases, amylases, lipases, hemicellulases, cellulases, perhydrolases or oxidoreductases, and also preferably mixtures thereof. These enzymes are in principle of natural origin; starting from the natural molecules, improved variants are available for use in detergents and cleaning agents and are preferably used accordingly. Detergents or cleaning agents contain enzymes preferably in total amounts of $1\times10^{-6}$ wt. % to 5 wt. %, in relation to active protein. The protein concentration can be determined with the aid of known methods, for example the BCA method or the Biuret method.

Among the proteases, those of the subtilisin type are preferred. Examples include the subtilisins BPN' and Carlsberg as well as the developed forms thereof, the protease PB92, the subtilisins 147 and 309, the alkaline protease from *Bacillus lentus*, subtilisin DY, and the enzymes thermitase, proteinase K, which are assigned to the subtilases, but not subtilisins in the narrower sense, and the proteases TW3 and TW7.

Examples of amylases that can be used are the α-amylases from *Bacillus licheniformisi*, from *B. amyloliquefaciens* or from *B. stearothermophilus*, from *Aspergillus niger*, and *A. oryzae* and also the developments of the aforementioned amylases improved for use in detergents and cleaning agents. Furthermore, the α-amylase from *Bacillus* sp. A 7-7 (DSM 12368) and the cyclodextrin glucanotransferase (CGTase) from *B. agaradherens* (DSM 9948) should also be noted for this purpose.

Lipases or cutinases can be used on account of their triglyceride-cleaving activity. These include, for example, those lipases obtained or developed originally from *Humicola lanuginosa* (*Thermomyces lanuginosus*), in particular those with the D96L amino acid substitution. By way of example the cutinases isolated originally from *Fusarium solani pisi* and *Humicola insolens* can also be used. Lipases and/or cutinases of which the starting enzymes have been isolated originally from *Pseudomonas mendocina* and *Fusarium solanii* can also be used.

Enzymes can also be used that are summarized under the term hemicellulases. These include, by way of example, mannanases, xanthan lyases, pectin lyases (=pectinases), pectinesterases, pectate lyases, xyloglucanases (=xylanases), pullulanases, and β-glucanases.

In order to increase the bleaching effect, oxidoreductases can be used as desired, for example oxidases, oxygenases, catalases, peroxidases, such as halo, chloro, bromo, lignin, glucose or manganese peroxidases, dioxygenases or laccases (phenoloxidases, polyphenoloxidases). Organic compounds interacting with the enzyme are advantageously preferably additionally added, particularly preferably aromatic compounds, in order to intensify the activity of the oxidoreductases in question (enhancers) or in order to ensure the electron flow in the case of highly different redox potentials between the oxidizing enzyme and the stains (mediators).

The enzymes can be used in any form established in accordance with the prior art. These forms include, for example, the solid preparations obtained by granulation, extrusion or lyophilization, or (in particular in the case of liquid or gel-like agents) solutions or enzymes, advantageously concentrated to the greatest possible extent, having a low water content and/or mixed with stabilizers. Alternatively, the enzymes can be encapsulated both for the solid and for the liquid delivery form, for example encapsulated by spray drying or extrusion of the enzyme solution together with a preferably natural polymer or in the form of capsules, for example those in which the enzymes are enclosed as in a hardened gel or in those of the core-shell type, in which an enzyme-containing core is coated by a water-, air- and/or chemical-impermeable protective layer. Further active substances, for example stabilizers, emulsifiers, pigments, bleaches or dyes can additionally be applied in built-up layers. Capsules of this type are applied in accordance with methods known per se, for example by vibratory or rolling granulation or in fluid-bed processes. Granulates of this type advantageously are low in dust, for example by application of polymer film formers, and are stable under storage on account of the coating. It is also possible to package two or more enzymes together, such that an individual granulate has a number of enzyme activities.

One or more enzymes and/or enzyme preparations, preferably protease preparations and/or amylase preparations, is/are preferably used in amounts of from 0.1 wt. % to 5 wt. %, preferably from 0.2 wt. % to 4.5 wt. %, and in particular from 0.4 wt. % to 4 wt. %.

Individual odorous substance compounds can be used as perfume oils and fragrances, for example synthetic products of the ester, ether, aldehyde, ketone, alcohol and hydrocarbon type. However, mixtures of various odorous substances are preferably used, which together produce a pleasant fragrance note. Such perfume oils can also contain natural odorous substance mixtures, as are accessible from plant sources, for example pine oil, citrus oil, jasmine oil, patchouli oil, rose oil or ylang-ylang oil. In order to be perceptible, an odorous substance must be volatile, wherein, besides the nature of the functional groups and the structure of the chemical compound, the molar mass also plays a key role. Most odorous substances thus have molar masses up to approximately 200 g/mol, whereas molar masses of 300 g/mol and above tend to be the exception. Due to the different volatility of the odorous substances, the smell of a perfume or fragrance composed from a number of odorous substances changes during the evaporation, wherein the impressions of the smell are divided into top notes, middle notes (body) and end notes (dry out). Since the perception of a fragrance is also based largely on the intensity of the fragrance, the top note of a perfume or fragrance does not consist solely of easily volatile compounds, whereas the end note consists primarily of aromas that are not very volatile, i.e. are sticky. In the composition of perfumes, very volatile aromas can be bound for example at specific fixatives, whereby said aromas are prevented from quickly evaporating. In the subsequent division of the aromas into "very volatile" or "sticky" odorous substances, there is no indication of the fragrance impression or whether the corresponding odorous substance is perceived as a top note or middle note. The fragrances can be processed directly, however it can also be advantageous to apply the fragrances to carriers which ensure long-lasting fragrance by means of a slower fragrance release. By way of example, cyclodextrins have proven their worth as carrier materials of this type, wherein the cyclodextrin-perfume complexes additionally can be coated also with further auxiliaries.

When choosing the dye it must be taken into consideration that the dyes can have a high storage stability and an insensitivity to light as well as not too strong an affinity to textile surfaces and, in this case in particular, to synthetic fibers. At the same time, it can also be taken into consideration that dyes can have different stabilities with respect to oxidation. Generally, water-insoluble dyes are more stable in respect of oxidation than water-soluble dyes. The concentration of the dye in the detergents or cleaning agents varies depending on the solubility, and therefore also depending on the oxidation sensitivity. In the case of dyes that are water-soluble in an effective manner, typical dye concentrations are selected in the region of a few $10^{-2}$ wt. % to $10^{-3}$ wt. %. In the case of pigment dyes, which are particularly preferred on account of their brilliance, but are not as easily soluble in water, the suitable concentration of the dye in the detergents or cleaning agents is by contrast typically a few $10^{-3}$ wt. % to $10^{-4}$ wt. %. Dyes that can be oxidatively broken down in the washing process are preferred, as well as mixtures thereof with suitable blue dyes, or what are known as blue toners. It has proven to be disadvantageous to use dyes which are soluble in water or at room temperature in liquid organic substances. By way of example, anionic dyes are suitable, for example anionic nitroso dyes.

In addition to the aforementioned components, the detergents or cleaning agents can also contain ingredients which further improve the performance and/or aesthetic properties of these agents. Preferred agents contain one or more substances from the group of electrolytes, pH adjusters, fluorescence agents, hydrotropes, foam inhibitors, silicone oils, anti-redeposition agents, optical brighteners, anti-graying agents, anti-shrink agents, anti-crease agents, color transfer inhibitors, antimicrobial active substances, germicides, fungicides, antioxidants, antistatic agents, ironing aids, repellants and impregnating agents, swelling and anti-slip agents and UV absorbers.

A wide number of different salts from the group of inorganic salts can be used as electrolytes. Preferred cations are the alkaline and alkaline earth metals, preferred anions are the halides and sulfates. In terms of production, the use of NaCl or $MgCl_2$ in the detergents or cleaning agents is preferred.

In order to bring the pH value of detergents or cleaning agents into the desired range, the use of pH adjusters may be indicated. Here, all known acids or lyes can be used, provided the use thereof is not prohibited for application-related or ecological reasons or for reasons of consumer protection. The quantity of these adjusters normally does not exceed 1 wt. % of the total formulation.

Soaps, oils, fats, paraffins, or silicone oils are possible foam inhibitors and can be applied to carrier materials as appropriate. By way of example, inorganic salts such as carbonates or sulfates, cellulose derivatives, or silicates and also mixtures of the aforementioned materials are suitable as carrier materials. Within the scope of the present invention, preferred agents contain paraffins, preferably unbranched paraffins (n-paraffins) and/or silicones, preferably linear-polymer silicones, which are structured in accordance with the schema $(R_2SiO)_x$ and are also referred to as silicone oils. These silicone oils are usually clear, colorless, neutral, odor-free, hydrophobic liquids with a molecular weight between 1,000 g/mol and 150,000 g/mol and viscosities between 10 mPa·s and 1,000,000 mPa·s.

The polymers of phthalic acid and/or terephthalic acid and derivatives thereof known from the prior art, in particular polymers of ethylene terephthalate and/or polyethylene glycol terephthalate or anionically and/or non-ionically modified derivatives thereof are possible soil repellants. Of these, the sulfonated derivatives of phthalic acid and terephthalic acid polymers are particularly preferred.

Optical brighteners in particular can be added to the detergents in order to overcome graying and yellowing of the treated textiles. These substances are drawn onto the fibers and cause a lightening and feigned bleaching effect by converting invisible ultra-violet radiation into visible light of longer wavelength, wherein the ultra-violet light absorbed from the sunlight is irradiated as faintly blue fluorescence and gives pure white together with the yellow tone of the grayed or yellowed laundry. Suitable compounds originate for example from the substance classes of 4,4'-diamino-2,2'-stilbene disulfonic acids (flavonic acids), 4,4'-distyryl biphenylene, methylumbelliferones, coumarins, dihydroquinolines, 1,3-diarylpyrazolines, naphthalic acid imides, benzoxazole, benzisoxazole, and benzimidazole systems and also the pyrene derivatives substituted by heterocycles.

Anti-graying agents have the task of keeping the dirt that is detached from the fiber suspended in the liquor, thus preventing the dirt from being redeposited. Water-soluble colloids, usually of organic nature, are suitable for this purpose, for example the water-soluble salts of polymer carboxylic acids, glue, gelatin, salts of ether sulfonic acids of starch or of cellulose or salts of acidic sulfuric acid esters of cellulose or of starch. Water-soluble polyamides containing acidic groups are also suitable for this purpose. Furthermore, soluble starch preparations can be used, for example degraded starch and aldehyde starches. Polyvinylpyrrolidone can also be used. Cellulose ethers such as carboxymethyl cellulose (Na salt), methyl cellulose, hydroxyalkyl cellulose, and mixed ethers such as methyl hydroxyethyl cellulose, methyl hydroxypropyl cellulose, methyl carboxymethyl cellulose and the mixtures thereof can also be used as anti-graying agents. For example, non-ionic cellulose ethers such as methyl cellulose and methyl hydroxypropyl cellulose having a proportion of methoxy groups of from 15 to 30 wt. % and a proportion of hydroxypropyl groups of from 1 to 15 wt. %, in each case in relation to the non-ionic cellulose ether, are particularly suitable.

Since textile fabrics, in particular composed of rayon, viscose, cotton and blends thereof, can tend to crease because the individual fibers are sensitive to bending, kinking, pressing and squeezing transversely to the fiber direction, synthetic anti-crease agents can be used. These include, for example, synthetic products based on fatty acids, fatty acid esters, fatty acid amides, alkylol esters, alkylol amides, or fatty alcohols, which are usually reacted with ethylene oxide, or products based on lecithin or modified phosphoric acid esters.

Repellant and impregnation methods serve to provide textiles with substances which prevent the deposit of dirt or facilitate the capability for dirt to be washed out. Preferred repellant and impregnating agents are perfluorinated fatty acids, also in the form of the aluminum and zirconium salts thereof, organic silicates, silicones, polyacrylic acid esters with perfluorinated alcohol component or polymerizable compounds coupled with perfluorinated acyl or sulfonyl group. Antistatic agents can also be contained. The provision of repellants and impregnating agents, which have a dirt-repelling effect, is often classed as an easy-care finish. The penetration of the impregnating agent in the form of solutions or emulsions of the active substances in question can be facilitated by the addition of wetting agents, which reduce the surface tension. A further field of use of repellants and impregnating agents is providing textile goods, tents, tarpaulins, leathers, etc. with a water-repellant finish, wherein, in contrast to waterproofing, the tissue pores are not closed, i.e. the substance remains breathable (hydrophobization). The water repellants used for hydrophobization coat textiles, leathers, papers, wood, etc. with a very thin layer of hydrophobic groups, such as longer alkyl chains or siloxane groups. Suitable water repellants are, for example, paraffins, waxes, metal soaps, etc. with additives of aluminum or zirconium salts, quaternary ammonium compounds with long-chain alkyl groups, urea derivatives, fatty acid-modified melamine resins, chromium complex salts, silicones, tin-organic compounds and glutaraldehyde and also perfluorinated compounds. The hydrophobized materials do not feel greasy; however, water droplets run off them, similarly to greased materials, without wetting them. For example, silicone-impregnated textiles for example have a soft feel and repel water and dirt; stains formed from inks, wine, fruit juices and the like are more easily removed.

Antimicrobial active substances can be used in order to combat microorganisms. Here, a distinction is made on the basis of antimicrobial spectrum and mechanism of action between bacteriostatics and bactericides, fungistatics and fungicides, etc. Substances from these groups include, for example, benzalkonium chlorides, alkylaryl sulfonates, halogen phenols and phenolmercuriacetate, wherein these compounds can also be completely dispensed with.

In order to prevent undesirable modifications to the detergents and/or the treated textiles, caused by the action of oxygen and other oxidative processes, the agents can contain antioxidants. This compound class includes, for example, substituted phenols, hydroquinones, brenzcatechols and aromatic amines and also organic sulfides, polysulfides, dithiocarbamates, phosphites and phosphonates.

An increased wearing comfort can result from the additional use of antistatic agents. Antistatic agents increase the surface conductivity and thus enable an improved run-off of formed charges. External antistatic agents are generally substances having at least one hydrophilic molecule ligand and provide a more or less hygroscopic film on the surfaces. These antistatic agents, which are mostly surface-active, can be divided into nitrogen-containing antistatic agents (amines, amides, quaternary ammonium compounds), phosphorous-containing antistatic agents (phosphoric acid esters) and sulfur-containing antistatic agents (alkyl sulfonates, alkyl sulfates). Lauryl (or stearyl) dimethylbenzyl ammonium chlorides are also suitable as antistatic agents for textiles or as additive to detergents, wherein a softening effect is attained in addition.

In order to improve the water absorption capacity and the re-wettability of the treated textiles and in order to facilitate ironing of the treated textiles, silicone derivatives for example can be used in textile detergents. These additionally improve the rinse-out behavior of the detergents or cleaning agents on account of their foam-inhibiting properties. Preferred silicone derivatives include, for example, polydialkyl siloxanes or alkylaryl siloxanes, in which the alkyl groups contain one to five C atoms and are fully or partially fluorinated. Preferred silicones are polydimethyl siloxanes, which can be derivatized where appropriate and then are amino-functional or quaternized or contain Si—OH bonds, Si—H bonds and/or Si—Cl bonds. Further preferred silicones are the polyalkylene oxide-modified polysiloxanes, i.e. polysiloxanes which for example contain polyethylene glycols, and also the polyalkylene oxide-modified dimethyl polysiloxanes.

Lastly, UV absorbers can also be used, which are drawn onto the treated textiles and improve the light resistance of the fibers. Compounds that have these desired properties include, for example, the compounds and derivatives, effective by radiation-free deactivation, of benzophenone with substituents in the 2- and/or 4-position. Furthermore, substituted benzotriazoles, acrylates which are phenyl-substituted in the 3-position (cinnamic acid derivatives), possibly with cyano groups in the 2-position, salicylates, organic Ni-complexes and also natural substances, such as umbelliferone and endogenous urocanic acid, are also suitable.

Protein hydrolyzates are further suitable active substances on account of their fiber-caring effect. Protein hydrolyzates are product mixtures obtained by acid-, base- or enzyme-catalyzed degradation of proteins. Protein hydrolyzates of both plant and animal origin can be used. Animal protein hydrolyzates are, for example, elastin, collagen, keratin, silk and milk protein hydrolyzates, which can also be present in the form of salts. The use of protein hydrolyzates of plant origin are preferred, for example soy, almond, rice, pea, potato and wheat protein hydrolyzates. Although the use of protein hydrolyzates as such is preferred, amino acid mixtures obtained in other ways can optionally also be used instead, or individual amino acids can be used, for example arginine, lysine, histidine or pyroglutaminic acid. The use of derivatives of protein hydrolyzates, for example in the form of their fatty acid condensation products, is also possible.

Examples

Washing tests were performed at 40° C. with the standardized stains specified in Table 1 on cotton with use of a bleach-free liquid detergent V1 (dosing 69 g to 17 l of water of 16° dH) and a mixture M1 composed of detergent V1 and 8-hydroxy-5-quinoline sulfonic acid (compound A)

A

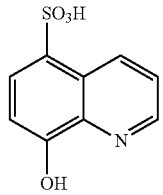

(dosing 69 g V1 and 1 g A to 17 l of water of 16° dH). After drying the cotton cloths, the lightness thereof was determined with the aid of the color distance measurement in accordance with the L*a*b* values and the Y values calculated therefrom as measure for the lightness. Table 1 shows the differences between the difference values dY, which were given from the difference Y (after washing)−Y (before washing) between M1 and V1.

TABLE 1

Differences in lightness difference

| Stain | M1 |
|---|---|
| Red wine | 2.6 |
| Grass | 2.5 |
| Salad dressing | 2.7 |
| Blackcurrant juice | 3.1 |
| Blueberry juice | 4.9 |

The lightness differences with use of the substance essential to the invention were significantly greater than those obtained with use of the comparative detergent free from the substance, corresponding to a higher degree of whiteness and therefore an improved stain removal.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for improving washing or cleaning performance with respect to bleachable stains comprising the steps: (a) providing a detergent or cleaning composition comprising at least one surfactant and 8-hydroxy-5-quinoline sulfonic acid in an amount from 0.05 wt. % to 5 wt. %, by the weight of the total detergent or cleaning composition, and (b) bringing a textile having bleachable stains into contact with the detergent or cleaning agent;

wherein the composition contains builders but does not include an oxidative bleach agent; and wherein the composition is free of perfumes apart from the 8-hydroxy-5-quinoline sulfonic acid.

2. The method according to claim 1, wherein the stains comprise polymerizable substances.

3. The method according to claim 2, wherein the polymerizable substances are polyphenolic dyes.

4. The method according to claim 2, wherein the polymerizable substances are flavonoids.

5. The method according to claim 2, wherein the polymerizable substances are dyes in the class of anthocyanidins or anthocyanins, or oligomers thereof.

6. The method according to claim 1, wherein the improved detergent or cleaning agent performance includes an improved removal of green-, yellow-, red-, blue-, violet-, lilac-, brown-, purple-, or pink-colored stains.

7. The method according to claim 1, wherein the stains are selected from stains caused by cherry, morello cherry, grape, apple, pomegranate, chokeberry, plum, buckthorn, acai, kiwi, mango, grass, redcurrants, blackcurrants, elderberries, blackberries, raspberries, blueberries, cranberries, lingonberries, strawberries, huckleberries, coffee, tea, red cabbage, blood orange, eggplant, tomato, carrot, beetroot, spinach, peppers, red fleshed or blue-fleshed potatoes, red onion, spices, sauces, chutneys, curries, purees, marmalades, wines, and/or juices.

8. A laundry detergent or cleaning composition comprising at least one surfactant and 8-hydroxy-5-quinoline sulfonic acid in an amount from 0.05 wt. % to 5 wt. %, by the weight of the total detergent or cleaning composition, wherein the composition contains builders but does not include an oxidative bleach agent; and wherein the composition is free of perfumes apart from the 8-hydroxy-5-quinoline sulfonic acid.

9. The composition according to claim 8, wherein the oxidative bleach agent is selected from the group consisting of hypochlorites, hydrogen peroxide, hydrogen peroxide-supplying substances, and peroxoacids.

10. The composition according to claim 8, further comprising constituents of textile detergents selected from the group of builders, surfactants, and a mixture thereof.

11. The method according to claim 1 wherein the 8-hydroxy-5-quinoline sulfonic acid is present in the composition in an amount of about 0.4 wt. % by the weight of the total detergent or cleaning composition.

12. The composition according to claim 8 wherein the 8-hydroxy-5-quinoline sulfonic acid is present in an amount of about 0.4 wt. % by the weight of the total detergent or cleaning composition.

13. The method according to claim 1, wherein the oxidative bleach agent is selected from the group consisting of hypochlorites, hydrogen peroxide, hydrogen peroxide-supplying substances, and peroxoacids.

14. The method according to claim 1, where the composition further comprises constituents of textile detergents selected from the group of builders, surfactants, and a mixture thereof.

* * * * *